US006744615B1

(12) United States Patent
Melbert et al.

(10) Patent No.: US 6,744,615 B1
(45) Date of Patent: Jun. 1, 2004

(54) DEVICE FOR CONTROLLING AN ELECTROMECHANICAL REGULATOR

(75) Inventors: Joachim Melbert, Deisenhofen (DE); Stefan Butzmann, Hagen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/582,258

(22) PCT Filed: Dec. 22, 1998

(86) PCT No.: PCT/DE98/03787

§ 371 (c)(1),
(2), (4) Date: Nov. 27, 2000

(87) PCT Pub. No.: WO99/34378

PCT Pub. Date: Jul. 8, 1999

(30) Foreign Application Priority Data

Dec. 23, 1997 (DE) ..... 197 57 611
Apr. 30, 1998 (DE) ..... 198 19 578

(51) Int. Cl.[7] ..... H01H 9/00
(52) U.S. Cl. ..... 361/154; 361/187
(58) Field of Search ..... 361/143, 152, 361/153, 154, 159, 167, 170, 183, 187–191, 195, 196; 123/90.11, 90.15

(56) References Cited

U.S. PATENT DOCUMENTS

| | | | | | |
|---|---|---|---|---|---|
| 4,823,825 | A | * | 4/1989 | Buchl | 137/1 |
| 4,907,901 | A | * | 3/1990 | Mitchell | 400/157.2 |
| 5,481,187 | A | * | 1/1996 | Marcott et al. | 324/207.16 |
| 6,285,151 | B1 | * | 9/2001 | Wright et al. | 318/560 |

FOREIGN PATENT DOCUMENTS

| | | | |
|---|---|---|---|
| DE | 195 26 683 A1 | 1/1997 | H01F/7/18 |
| DE | 195 30 798 A1 | 2/1997 | H01F/7/18 |
| EP | 0 172 712 A2 | 2/1986 | H01F/7/18 |
| GB | 2 279 829 A | 1/1995 | H01F/7/18 |

* cited by examiner

*Primary Examiner*—Ronald W. Leja
(74) *Attorney, Agent, or Firm*—Baker Botts L.L.P.

(57) ABSTRACT

A device for controlling an electromechanical regulator, including a controller (3*a*) that controls the current through a coil (113) and which, for that purpose, generates control signals for a power regulator (5*a*). The control signals are determined with the coil (113) operating in the free-running operating state. The control signals depend, during the movement of the armature, on the current and the time differential of the current through the coil (113).

9 Claims, 6 Drawing Sheets

Start
S1
Constant Current Adjustment
S2
Switch Over in Free-running Mode (T1=off, T2=on)
S4
Wait TD2
S5
S6
1<I Current Limit
j
n
S7
KS=H?
j
n
S8
Energy Supply (T1=on, T2=on)
S9
Wait TD3
Energy Drain (T1=off, T2=off)
S9
Wait TD4
S10
S11
Increased Holding Current Adjustment
Wait TD5
S12
Holding Current Adjustment
S13
Stop
S14

DEVICE FOR CONTROLLING AN ELECTROMECHANICAL REGULATOR

FIELD OF THE INVENTION

The invention concerns a device for controlling an electromechanical regulator provided in particular for controlling an internal combustion engine.

BACKGROUND OF THE INVENTION

A known regulator (DE 195 26 683 A1) has an actuator designed as a gas shuttle valve and an actuating drive. The actuating drive has two electromagnets, between which an armature plate can be moved against the force of a return mechanism by switching off the coil current on the holding electromagnet and switching on the coil current on the capturing electromagnet. The coil current of the capturing electromagnet is kept constant by a preset capture value for a preset length of time and is then adjusted to a holding value by a two-position hysteresis controller.

Increasingly strict legal limits on the noise levels produced by a motor vehicle and demands for a quiet running internal combustion engine require that minimal noise be produced by the regulator for useful mass production. The regulator must also be guaranteed to be long lasting for useful mass production.

BRIEF SUMMARY OF THE INVENTION

It is the task of this invention to create a device for controlling an electromechanical regulator which minimizes the noise produced when an armature plate contacts an electromagnet and also guarantees that the regulator will last a long time.

This problem is solved by the features of claim 1. Advantageous configurations of the invention are found in the subclaims.

In a coil through which a current flows and with which a moving plate of the armature is associated, there is, with an unsaturated magnetic circuit and a negligible stray flux, a clear connection between current I through the coil, the time differential of current dI/dt, air gap length l and velocity v of the armature. In the case of dominating magnetic resistance of the air gap to the remaining magnetic circuit, the following relationship can be found:

$$\frac{dI}{dt} = -\left[\frac{2P_{v,el}l}{AIN^2\mu_o} + \frac{Iv}{l}\right] \quad \text{(G1)}$$

in which:

A is the bearing surface of the core of the electromagnet on which the armature plate is seated, N is the number of windings in the coil, $P_{v,el}$ is the dissipated electrical power, and $\mu_0$ is the air permeability.

The invention is based on the recognition that the first summand of relationship (G1) is negligible compared with the second summands of equation (G1) if the ratio of dissipated electrical power $P_{v,el}$ and current I is low. The ratio of dissipated electrical power $P_{v,el}$ and current I is almost zero when the coil is operated in the free-running operating state. Thus, in this case, the relationship $$\frac{\dot{I}}{I} = -\frac{v}{l} \quad \text{(G2)}$$

results roughly from relationship (G1).

Thus gentle impact with v approximately zero can be achieved as a function of the time differential of current dI/dt and current I through the coil with air gap length 1 at zero without a position sensor having to be provided to detect the present position of the armature in each case. Long life is guaranteed since the regulator is only lightly mechanically stressed due to the soft impact of the armature plate on the core.

The control signals of the controller are determined with the coil in the free-running operating state. In the free-running operating state, the coil is short-circuited via a free-running circuit of the power regulator. In the free running state, the current I through the coil can be detected almost without loss. Thus the approximation of relationship (G1) given by relationship (G2) is highly accurate.

When there is a deviation from the desired relationship of the time differential of current dI/dt and current I through the coil in the free run, depending on the polarity sign of the deviation, electrical energy is preferably supplied to the actuator coil or removed from the actuator coil for a limited time. The free-running operation is stopped and the coil is applied to the distribution voltage (energy supply) or the stored energy is drained from the distribution voltage (energy drain).

BRIEF DESCRIPTION OF THE DRAWINGS

Examples of embodiment of the invention arc illustrated in more detail by means of the schematic diagrams.

DETAILED DESCRIPTION OF THE INVENTION

Elements of the same construction and function are provided with the same reference numbers from figure to figure.

Figure 1:
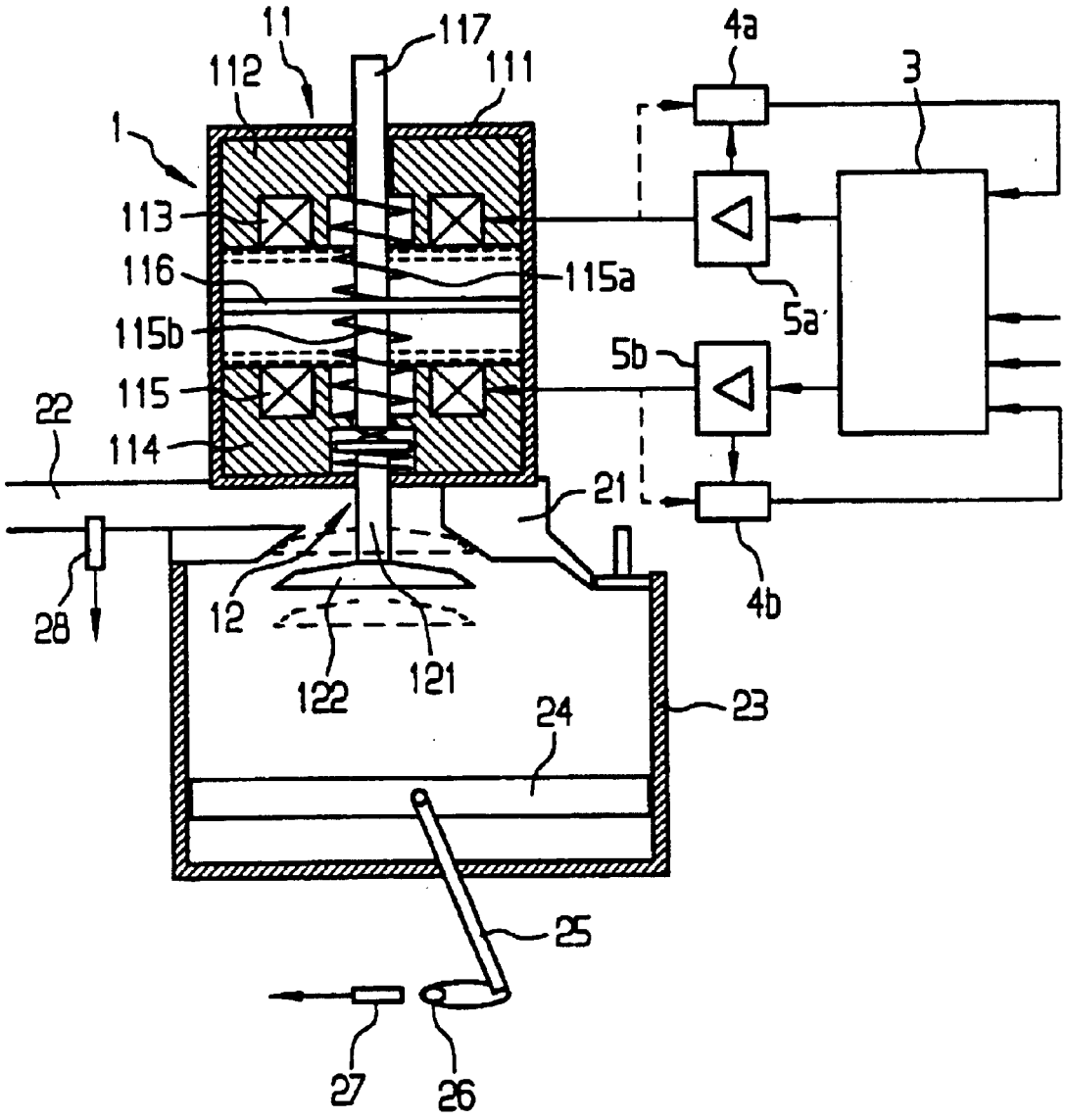
FIG. 1 shows a regulator arrangement in an internal combustion engine.

Regulator 1 (FIG. 1) comprises actuating drive 11 and actuator 12 which is designed, for example, as a gas shuttle valve and has shaft 121 and a disk. Actuating drive 11 has housing 111 in which first and second electromagnets are arranged. The first electromagnet has core 112 into which coil 113 is embedded in a ring-shaped groove.

The second electromagnet has 114 into which coil 115 is embedded in another ring-shaped groove. An armature is provided with armature plate 116 being arranged in housing 111 to be moved between core 112 and core 114. The armature also comprises armature shaft 117 that is guided by recesses in the first and second cores and which can be mechanically coupled with shaft 121 of the valve. Spring 115*a* and spring 115*b* pretension armature plate 116 to preset rest position R.

Regulator 1 is rigidly connected to cylinder head 21. Intake channel 22 and cylinder 23 with piston 24 are attached to cylinder head 21. Piston 24 is coupled with a crankshaft via connecting rod 25. Master controller 3 is provided which receives signals from sensors and generates adjustment signals depending on which coil 113 and coil 115 of regulator 1 are driven by power regulator 5*a* and power regulator 5*b*. The sensors are designed as current meter 4*a* which detects current through coil 113 or current in the power regulator 5*a*, or as current meter 4*a* which detects current through coil 115 or in power regulator 5*b*. There may be other sensors in addition to the sensors mentioned.

Figure 2:
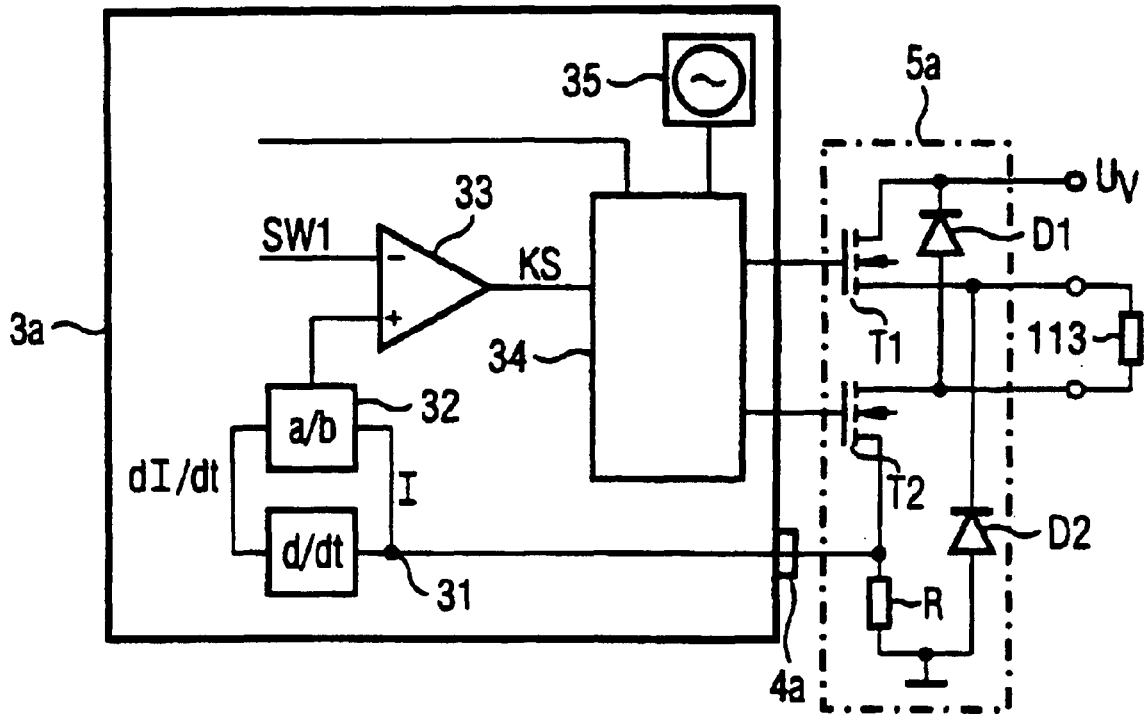
FIG. 2 shows a block diagram of a controller in the control device and an attached power element.
Figure 2A:
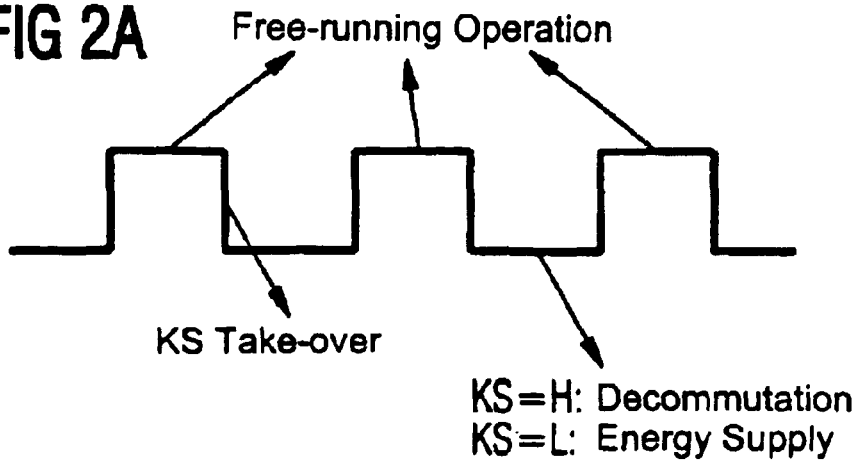

FIG. 2 shows the part of master controller 3 relevant to understanding the invention. Controller 3*a* is provided which generates adjustment signals for power regulator 5*a* as a function of current I through coil 113 as measured by current meter 4*a*.

Current I is differentiated in differentiator 31. The ratio of the time differential dI/dt of current I and current I is ascertained in divider 32. Comparator 33 is provided the input of which is a preset threshold value SW1 and the output of divider 32. Output signal KS of comparator 33 is at high level H if the preset threshold value SW1 is lower than the output of divider 32. Otherwise, the output signal of the comparator 33 is at a low level.

Logic unit 34 is provided which generates the adjustment signals for power regulator 5*a* as a function of the comparator 33 output signal KS, oscillator 35 timing signal TS and other operating parameters. The construction of logic unit 34 is further illustrated below in FIG. 3.

Power regulator 5*a* has transistor T1, the gate connection of which is electrically connected to one output of logic unit 34. Power regulator 5*a* has a second transistor T2, the gate connection of which is electrically connected to logic unit 34. Diode D1 and a second diode D2 are provided. Resistor R is also located between the source output of transistor T2 and the reference potential. Resistor R acts as a multiplier for current meter 4*a*.

If the high level H is applied at the gate connection of transistor T1, the transistor conducts from the drain to the source. If high-level H is also applied to transistor T2 at the gate side connection, transistor T2 also conducts. The distribution voltage $U_v$ then drops at the second coil reduced by the voltage drop at resistor R. Current I through the coil then rises.

If a low level is then preset at the gate side connection of transistor T1, transistor T1 does not conduct and diode D2 becomes conductive in the free-running state. The voltage drop at coil 113 is then given by the conducting-state voltage of diode D2 and transistor T2 and the voltage drop at resistor R (total of two volts for example). Current I through coil 113 then decreases.

If both the levels at the gate side connection of transistors T1 and T2 are switched from high to low, then both diode D1 and diode D2 become conductive and the current through the first coil is very rapidly decreased—so that decommutation occurs. Power regulator 5*b* is therefore designed analogously to power regulator 5*a*.

Figure 3:
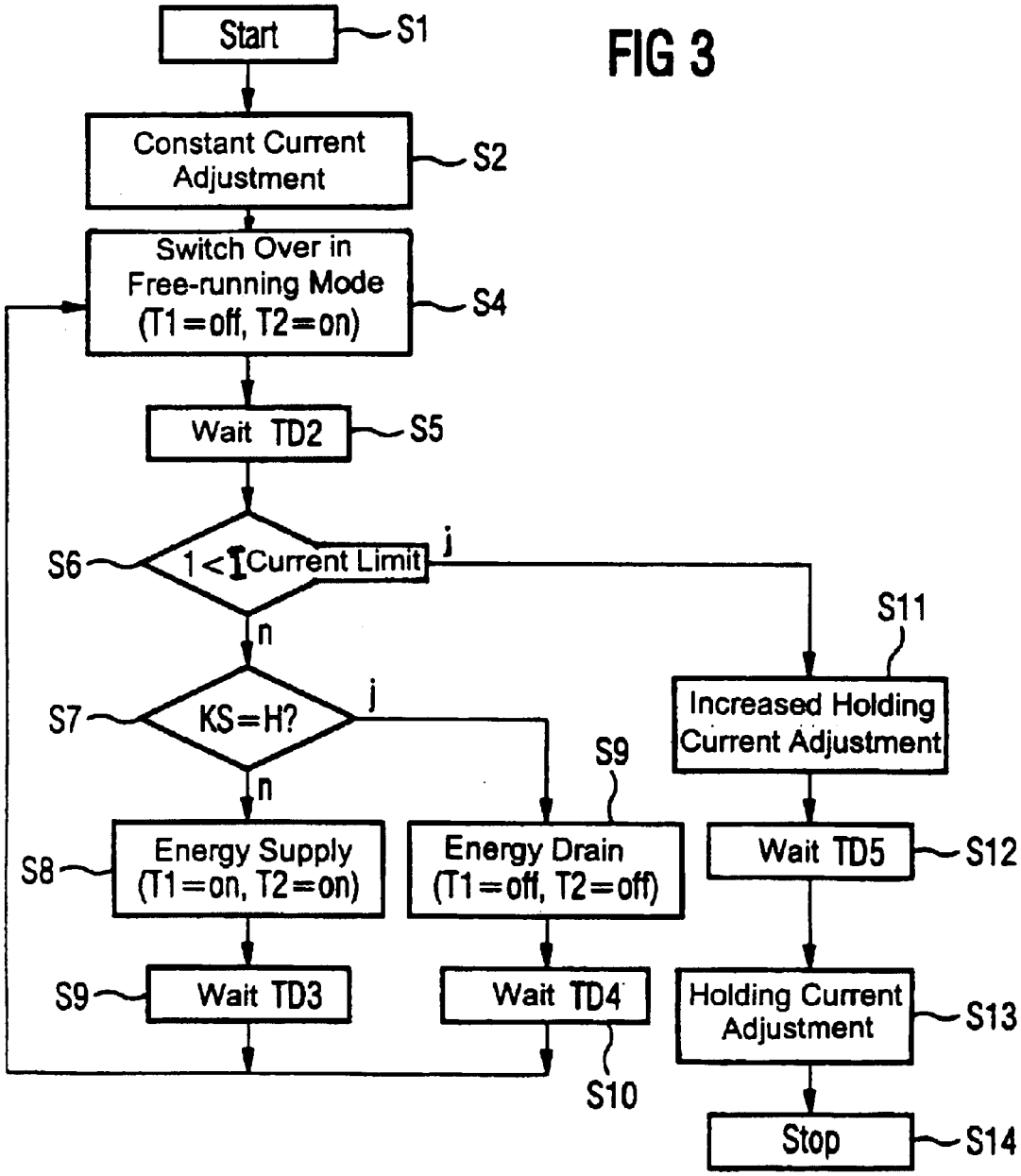
FIG. 3 shows a flow chart of a program that is run by a logic unit of the controller.

FIG. 3 shows a flow chart of a program as run in logic unit 34. It does not matter whether the program is hard-wired in or is run by a micro-controller.

The program is started in step S1. In step S2, the constant current through the coil is set, i.e., the current is set to an initial capture value for a preset first time delay TD1. A two-position hysteresis controller is provided for this purpose.

In step S4, transistor T1 is switched off and transistor T2 is switched on and the coil is thus operated in the free-running operating state. In step S5, there is a delay for a preset second time delay TD2. In step 6, there is a check to see if current I through coil 113 has fallen below a minimum limit current $I_{grenz}$ in the free-running operating state. If such is not the case, a check is performed in step S7 to see whether control signal KS from the first comparator 33 is at level H. If this is the case, the armature is too fast and transistors T1 and T2 are switched off in step S8, i.e., set to "off" and energy is therefore drained. If the condition of step S7 is not met, the armature is too slow and transistors T1 and T2 are switched on in step S9, i.e., set to "on" and energy is therefore supplied. In step S9, there is a preset third time delay TD3 and in step S10 a preset fourth time delay TD4. During the delay in steps S9 and S10, the drive of transistors T1 and T2 remains unchanged. The program then resumes in step S4.

If, in step S6, the current through the coil is less than the minimum limit current $I_{grenz}$, the current is adjusted to an increased holding current in steps S11 and S12 for a preset fifth time delay TD5. This ensures safer capturing of the armature. In step S13, the current through the coil is then set to a lower holding current.

The program ends in step S14.

Figure 4:
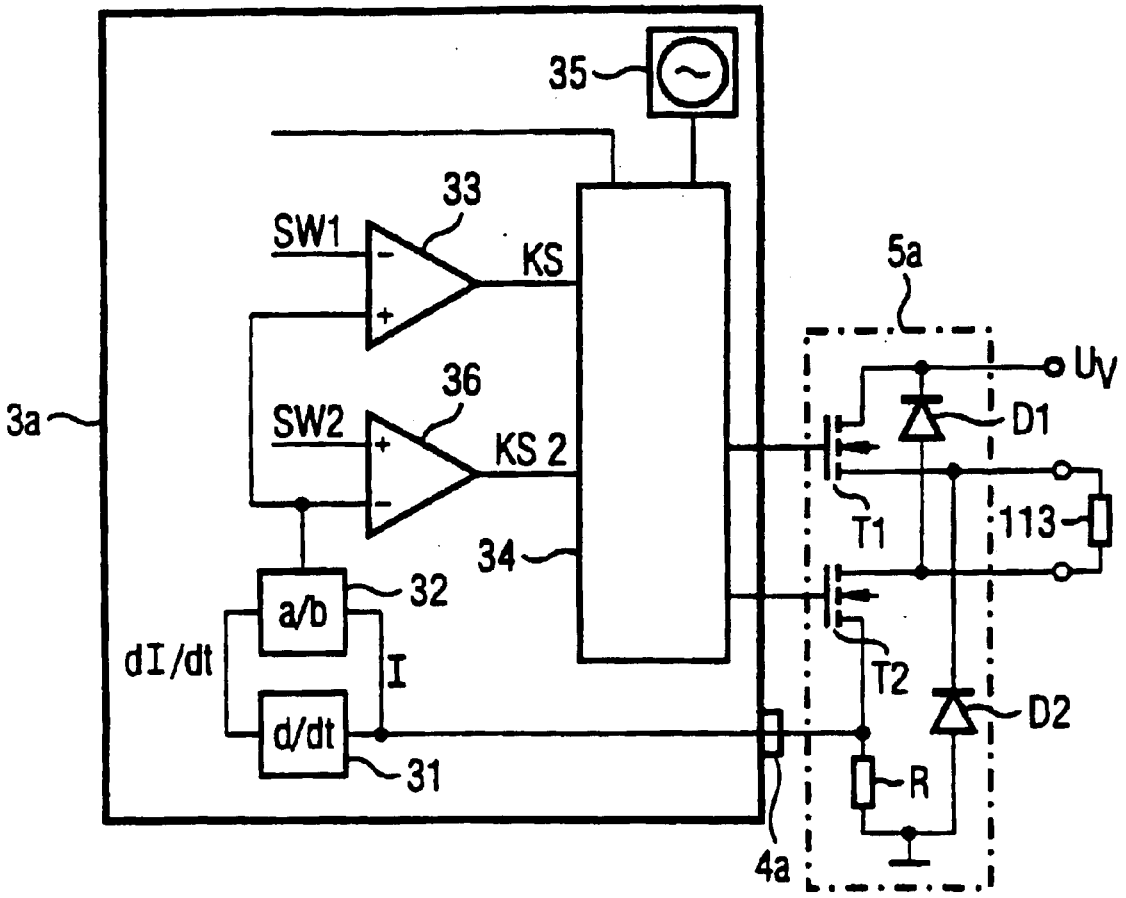
FIG. 4 shows a second embodiment of the controller.
Figure 4A:
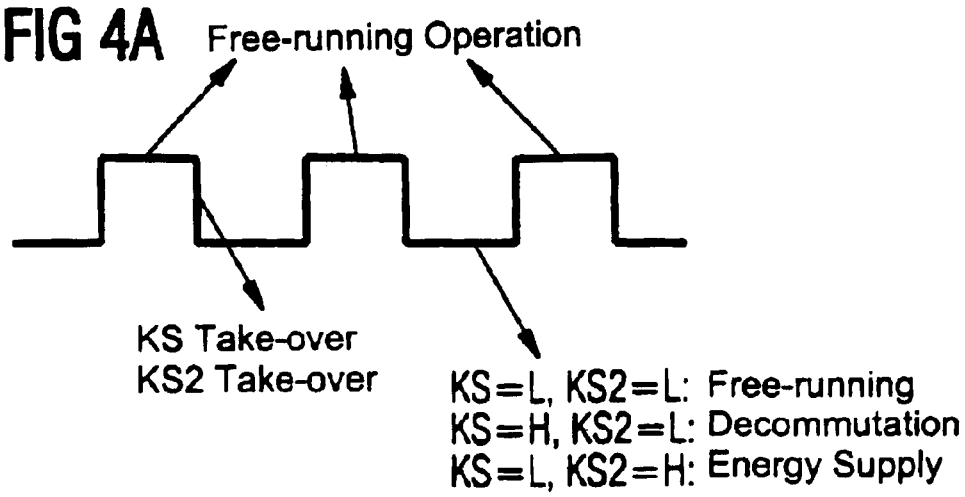

FIG. 4 shows a second embodiment of controller 3*a*. Unlike the embodiment in FIG. 2, a second comparator 36 is provided, the output signal of which depends on preset second threshold value SW2 and the output of divider 32. A version of logic unit 34 adapted to this embodiment is illustrated in FIG. 5.

D flip-flop 341 generates its output signal at the Q output as a function of oscillator 35 timing signal TS and the output signal of comparator 33. Another D flip-flop 342 is provided, the output signal of which at its Q output depends on oscillator 35 timing signal TS and the output signal of the second comparator 36. The input of NOT gate 343 is electrically connected to oscillator 35 and its output is electrically connected to one input of AND gate 344. The second input to AND gate 344 is electrically connected to the output of D flip-flop 342.

The output of D flip-flop 341 is electrically connected to the input of a second NOT gate 345. The output of NOT gate 345 is also connected, like oscillator 35, to OR gate 346. The outputs of AND gate 344 and OR gate 346 are led to the gate of transistor T1 and transistor T2 respectively. Optionally, a driver may also be located between the outputs of AND gate 344 and OR gate 346 to the gate of transistor T1 and transistor T2 respectively.

Figure 5:
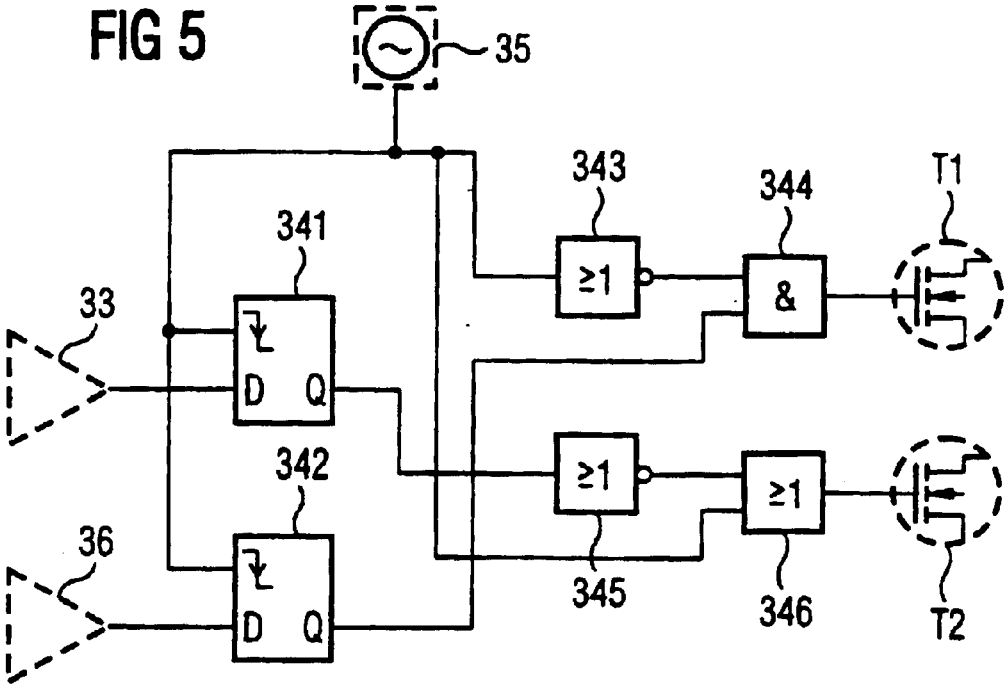
FIG. 5 shows a block diagram of the logic unit of the controller in FIG. 4, FIGS. 6*a* through 6*c* show signals of current I through the coil, position X of the coil and velocity V of the armature plate plotted over time t.

Due to the design of logic unit 34 in FIG. 5, the power regulator is always operated in the free-running operating state when the level of timing signal TS is high. If timing signal TS is at the low level, there is a three-position adjustment, i.e., either transistor T1 is switched off and transistor T2 is switched on, i.e., free-running operation, or both transistors are in the conducting mode, i.e., energy supply, or both transistors are not conducting, i.e., energy drain.

Instead of threshold values SW1 and SW1, only one threshold value may also be preset, and, in addition, a preset value may be added or subtracted at the pertinent inputs of the first comparators 33 and 36 respectively.

Figure 6B:
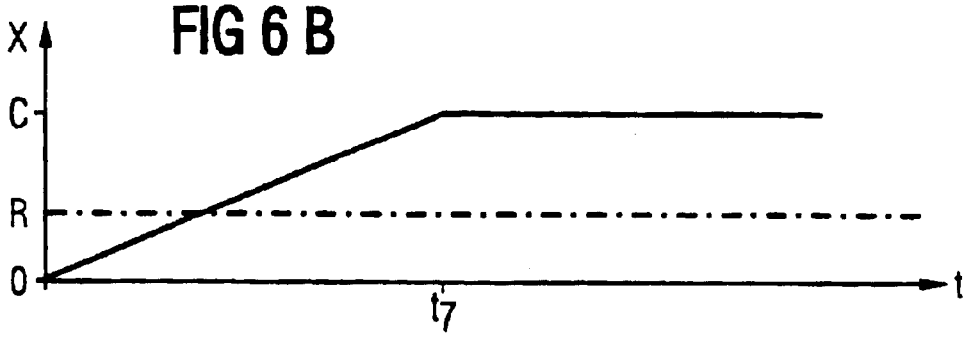
Figure 6C:
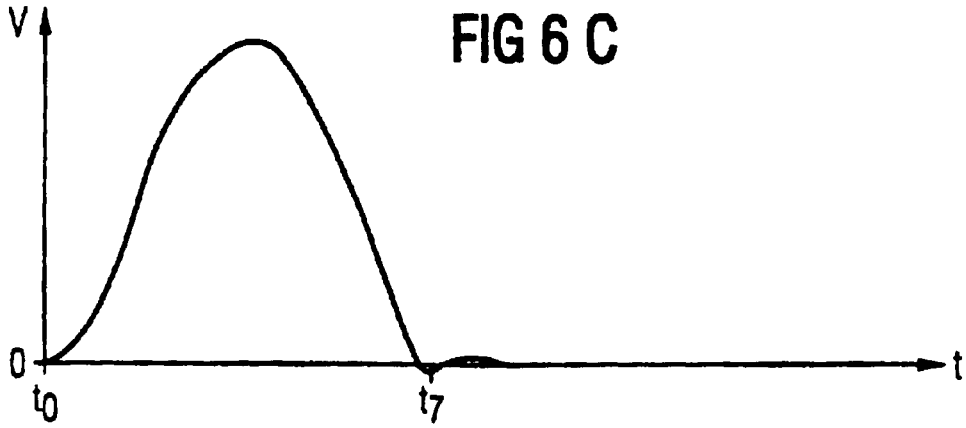
Figure 6A:
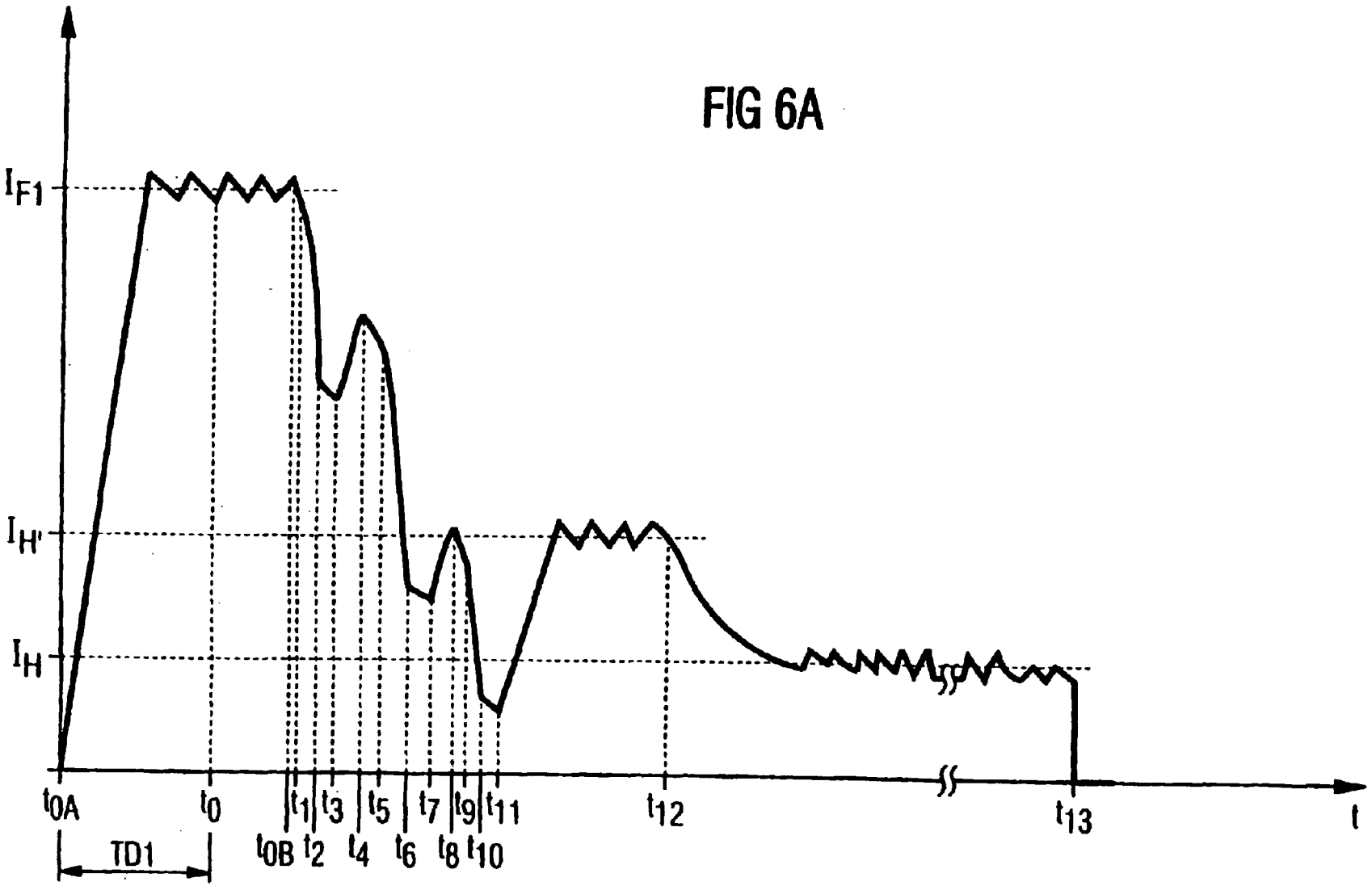

In FIG. 6*a*, the current through coil 113 is plotted over time t. In FIG. 6*b*, position X of armature plate 116 is plotted over time t. In FIG. 6*c*, velocity v of armature plate 116 is plotted over time t. At time $t_{0A}$, armature plate 116 begins to move from its open position O, i.e., its contact with the second electromagnet, toward its closed position C, i.e., contact with the first electromagnet. Initial capture value I-F1 for the current through the first coil 113 is preset.

The current through coil 113 is adjusted for preset time delay TD1 (e.g., 2 milliseconds) from the initial capture value I-F1. After time to, the current through coil 113 is adjusted by controller 3*a*.

From time $t_{0B}$ to time $t_1$, coil 113 is operated in the free-running operating state. The current through coil 113 is measured and the time differential of the current is determined. At time $t_1$, the relationship of the time differential dI/dt determined in the free-running state and current I is greater than the preset threshold value SW1. Accordingly, both transistor T1 and transistor T2 are switched off and the current drops sharply.

After time $t_2$, coil 113 is again operated in the free-running operating state and current I and its differential dI/dt are determined. At time $t_3$, the relationship of the time differential of current I determined in the free-running state and the current is smaller than the preset threshold value SW1. Both transistors T1 and T2 are switched on and the current through the coil increases until time $t_4$.

From time $t_4$ to time $t_5$, the coil is again operated in the free-running operating state. From time $t_5$ to time $t_6$, transistors T1 and T2 are both switched off, and decommutation therefore occurs again. From time $t_6$ to time $t_7$, the coil is again operated in the free-running state. From time $t_7$ to time $t_8$, transistors T1 and T2 are both switched on to conduct and the current rises until time $t_8$. From time $t_8$ to time $t_9$, decommutation again occurs. From time $t_{10}$ to time $t_{11}$, the coil is operated in the free-running operating state. At time $t_{11}$, current I through the coil in the free-running state becomes lower than a limit value of the current through the coil in the free-running state. The limit value is the value of the current in the free-running state as determined by testing at which the armature plate reaches the first coil. The limit value may be a firmly preset value or may be determined from a characteristic diagram depending on operating parameters.

From time $t_{11}$ to time $t_{12}$, an increased holding value I-H is preset at a nominal value of the current through the coil and adjusted by the controller (not shown). This ensures a more reliable capturing of the armature plate and softens the impact of the armature plate.

This increased holding value is preferably preset for a predetermined length of time until the current through the coil is adjusted by the controller (not shown) to holding value I-H from time $t_{12}$ to time $t_{13}$.

It can be clearly seen from velocity v of armature plate 116 that the armature plate meets the first electromagnet virtually at a velocity of zero.

The invention is not limited to the example of embodiment described. For example, the actuator may be designed as an injection valve. Each coil can also have its own controller. Energy can also be supplied to the coil until the current through the coil (113) has increased by a preset threshold value, if the ratio of the differential of current I and current I falls below a preset threshold value, and energy can be drained from the coil (113) until the current through the coil (113) has dropped by a preset threshold value if the ratio exceeds a preset threshold value. Alternatively, the supply or draining of energy to or from coil 113 may be performed by varying the amount of the voltage drop at coil 113 or by locking coil 113 onto a preset voltage that is different from the distribution voltage. A preset energy may be supplied to or drained from the coil in each case. It is best if the energy to be supplied or drained is estimated by an observer. The observer would estimate the energy, for example, depending on the deviation of the first or second threshold value from the ratio of the current I differential and current I.

The first and second threshold values applied to the inputs of the comparator may, alternatively, also be a function of the sizes and pressure in cylinder 23 or other operating parameters of the internal combustion engine or regulator.

Alternatively, the current I differential can be compared by the comparator with a threshold value that is a function of current I and/or other operating parameters.

There may also be any desired combination of the steps cited.

Controller 3*a* may also be designed as a continuous-action, discrete-time, P, PI, PD, PID or other familiar controller.

What is claimed is:

1. Device for controlling an electromechanical regulator which has an actuator (12) and an actuating drive (11) with an electromagnet having a coil (113), a movable armature and p1 a return mechanism mechanically coupled to the armature, in which:

a controller (3*a*) is provided which controls the current through the coil (113) and which for that purpose produces control signals for a power regulator (5*a*, 5*b*), and during the movement of the armature the control signals depend on the current and the time differential of the current through the coil (113) in the free-running operating state, characterized in that the control signals, if the armature has moved for longer than a preset first time delay (TD1) up to the end of the armature movement, depend on the current and the time differential of the current though the coil (113) in the free-running operating state.

2. Device for controlling an electromechanical regulator which has an actuator (12) and an actuating drive (11) with an electromagnet having a coil (113), a movable armature and a return mechanism mechanically coupled to the armature, in which:

a controller (3*a*) is provided which controls the current through the coil (113) and which for that purpose produces control signals for a power regulator (5*a*, 5*b*), and during the movement of the armature the control signals depend on the current and the time differential of the current through the coil (113) in the free-running operating state, characterized in that, in the free-running operating state, the potential difference on the coil is given by the potential difference at the power regulator's electronic components operating in the conductive state and resistor R.

3. Device for controlling an electromechanical regulator which has an actuator (12) and an actuating drive (11) with an electromagnet having a coil (113), a movable armature and a return mechanism mechanically coupled to the armature, in which:

a controller (3*a*) is provided which controls the current through the coil (113) and which for that purpose produces control signals for a power regulator (5*a*,

5*b*), the control signals depend on the ratio of the time differential of the current and the current through the coil (113), and during the movement of the armature the control signals depend on the current and the time differential of the current through the coil (113) in the free-running operating state.

4. Device as in claim 3, characterized in that energy is supplied to the coil if the ratio falls below a preset first threshold value and that energy is drained from the coil if the ratio exceeds a preset second threshold value.

5. Device as in claim 4, characterized in that energy is supplied to the coil for a preset time delay if the ratio falls below the preset first threshold value, and energy is drained from the coil for another preset time delay if the ratio exceeds the preset second threshold value, the another preset time delay being different than the preset time delay.

6. Device as in claim 4, characterized in that energy is supplied to the coil (113) until the current through the coil (113) has increased by another preset threshold value if the ratio falls below the preset first threshold value, and that energy is drained from the coil (113) until the current through the coil (113) has decreased by the another preset threshold value if the ratio exceeds the preset second threshold value.

7. Device as in claim 3, characterized in that the controller (3*a*) is designed as a two-position controller.

8. Device as in claim 3, characterized in that the controller (3*b*) is designed as a three-position controller.

9. Device as in claim 3, characterized in that the actuating drive has another electromagnet with another coil (115) and has another return mechanism, and that another controller is provided which regulates the current through the another coil (115).

* * * * *